United States Patent [19]

Eymard

[11] Patent Number: 4,597,113

[45] Date of Patent: Jul. 1, 1986

[54] INFLATABLE RESERVOIR FOR CONTAINING A LIQUID, MORE ESPECIALLY AN INFLATABLE SWIMMING POOL, AND A METHOD FOR FILLING SAME

[75] Inventor: Michel Eymard, Toulouse, France

[73] Assignee: Zodiac, Issy les Moulineaux, France

[21] Appl. No.: 714,247

[22] Filed: Mar. 21, 1985

[51] Int. Cl.[4] ..... E04H 3/18

[52] U.S. Cl. ..... 4/488; 4/499; 4/506; 4/585

[58] Field of Search ..... 4/488, 585, 496, 506, 4/487, 514, 499, 508, 503; 52/2

[56] References Cited

U.S. PATENT DOCUMENTS

| | | | |
|---|---|---|---|
| 2,505,845 | 5/1950 | Alvarez | 4/506 X |
| 2,529,872 | 11/1950 | Hasselquist | 4/506 |
| 2,551,673 | 5/1951 | Hasselquist | 4/506 |
| 2,616,096 | 11/1952 | Hasselquist | 4/506 |
| 2,714,726 | 8/1955 | Hasselquist | 4/506 |
| 2,719,982 | 10/1955 | Hasselquist | 4/506 |
| 3,681,789 | 8/1972 | Bott | 4/588 |
| 4,335,473 | 6/1982 | de Pous | 4/488 |
| 4,356,933 | 11/1982 | Connolly | 4/506 |

*Primary Examiner*—Henry K. Artis

*Attorney, Agent, or Firm*—Larson and Taylor

[57] ABSTRACT

An inflatable reservoir for containing a liquid, more especially an inflatable swimming pool, formed from a single sheet of a flexible and fluid tight material defining a bottom supporting thereover the liquid filling the reservoir and a peripheral space formed by the remainder of the sheet folded back on itself inwardly over the whole of its periphery so as to form approximately a tube filled partially with liquid and partially with gas, discontinuous mechanical connection means being provided for connecting the free edge of the folded down remainder of the sheet to the bottom.

6 Claims, 9 Drawing Figures

INFLATABLE RESERVOIR FOR CONTAINING A LIQUID, MORE ESPECIALLY AN INFLATABLE SWIMMING POOL, AND A METHOD FOR FILLING SAME

BACKGROUND OF THE INVENTION

1. Field of the Invention

The present invention relates to improvements to inflatable reservoirs for containing liquids, and more especially to inflatable swimming pools which are made from a flexible and fluid tight material; the invention also relates to a method for filling such a reservoir.

2. Description of the Prior Art

Numerous examples of liquid reservoirs are already known, more especially swimming pools, comprising a peripheral tube inflated by a pressurized gas (generally air), and surrounding a central region intended to contain the liquid (water in the case of swimming pools). Although such reservoirs are particularly advantageous from numerous points of view (low cost, ease of setting up, low weight when empty, ease of storing once deflated, etc . . . ), they have however an important disadvantage which is that the gas tightness of the peripheral tube is not perfect and this tube deflates gradually (leaks due to the permeability of the material and leaks at the filling valve). The imperfectly inflated tube risks collapsing under the action of the thrust of the liquid, with overspilling of the liquid. It is then necessary to regularly check the inflation condition of the peripheral tube and to reinflate it periodically To avoid having to carry out such checks and reinflation at too close intervals, it has already been proposed to cause the inner volume of the peripheral tube to communicate with the liquid filling space of the reservoir, so that a small amount of liquid penetrates into the bottom of the tube. The pressure of the inflation gas of the tube is therefore determined by the weight of the water column separating the levels of the liquid reigning in the tube and in the central region of the reservoir, and any gas leak is automatically compensated for a proportional rise of the level of the liquid in the tube. The inflation pressure of the tube, without being strictly constant, remains however sufficiently stable over a long period of time to allow the checks to be advantageously spaced apart. One example of such a construction is given in the U.S. Pat. No. 2,529,872 (VH Hasselquist). However, the proposed arrangement is extremely complex and requires numerous cut outs and extensive lengths of welding of the flexible material forming the reservoir. Furthermore, the lateral thrust exerted by the liquid is compensated for by an inner peripheral reinforcement which is extremely annoying for the users.

The aim of the invention is essentially to provide an inflatable reservoir, more especially a swimming pool, which combines the respective advantages of the prior reservoirs of the two above mentioned types, but which does not have the respective drawbacks.

SUMMARY OF THE INVENTION

To this end, the reservoir of the invention is formed by a single sheet of said material defining:

- a central zone forming the bottom over which is located the filling liquid of the reservoir,
- and a peripheral space formed by the rest of the sheet folded back on itself towards the inside over the whole of its periphery so as to form approximately a peripheral tube partially filled with liquid coming from the filling liquid of the reservoir and partially from gas coming from a filling gas,
- discontinuous mechanical connection means being provided for connecting the free edge of the folded back remainder of the sheet to the central zone.

The fact that the reservoir of the invention is formed by a single sheet leads to simple and rapid manufacture, using traditional methods and tools; in addition, it is easier to manufacture than prior reservoirs since it comprises no closed pocket; the fixing means and possibly holes provided in certain zones of this sheet are also easy to position and to handle; furthermore, it may be stored away rapidly for there is no longer need to empty air pockets and the sheet is simply folded flat. Thus, the reservoir of the invention has all the advantages of simplicity of manufacture, of use and of storage which conventional inflatable reservoirs offered, to which are added certain additional advantages.

Moreover, the existence of a gap between the peripheral space and the central region of the reservoir provides the advantages of reservoirs of the second above mentioned type.

Still for reasons of simplicity of manufacture and use, the discontinuous mechanical connection means are formed by lacing means.

For increased safety, the reservoir of the invention may possibly comprise a peripheral safety belt surrounding the tube.

For setting up the reservoir of the invention, the procedure may be as follows:

- the flexible sheet forming the reservoir is spread out on an approximately flat support:
  - the peripheral zone of the sheet is folded back inwardly so as to bring the free peripheral edge of the flexible sheet opposite fixing means provided on the periphery of the central zone of the flexible sheet,
  - the fixing means are secured so as to mechanically assemble the free edge of the sheet to the bottom,
  - liquid is introduced until the space between the free edge of the sheet and the bottom is covered,
  - gas is fed into the peripheral space so that this latter assumes approximately the shape of a tube, until excess gas escapes,
  - filling the reservoir with liquid is completed.

Preferably, filling with gas takes place through a pressurized gas feed tube whose end is fitted between the free edge of the sheet and the bottom.

BRIEF DESCRIPTION OF THE DRAWINGS

The invention will be better understood from reading the following description of some embodiments given solely by way of non limitative examples. In this description, reference is made to the accompanying drawings in which.

DESCRIPTION OF THE PREFERRED EMBODIMENTS

Figure 1:
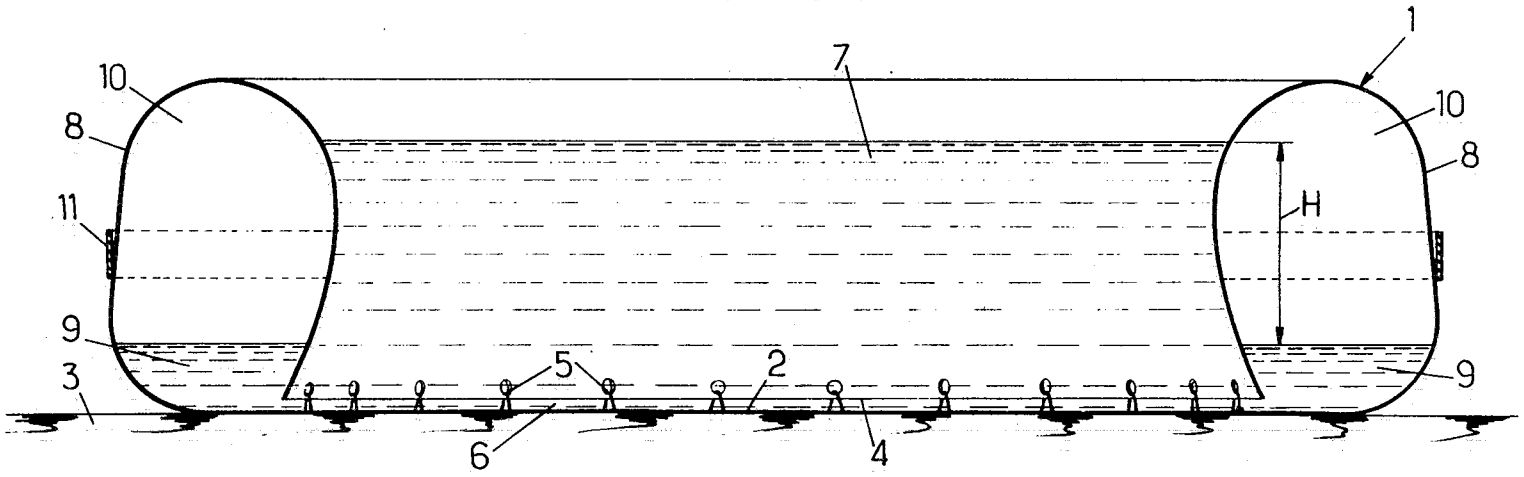
FIG. 1 is a schematical cross sectional view of an inflatable reservoir in accordance with the invention, shown in the position of use.

Referring first of all to FIG. 1, the reservoir of the invention has overall the general appearance of conventional inflatable reservoirs, that is to say that it is formed by a peripheral tube inflated by a pressurized gas (air as a rule) and sealingly surrounding a central region whose bottom supports thereover the liquid reserve.

According to the invention, the reservoir is formed by a flexible and deformable fluid tight sheet 1 of any known type for the application contemplated.

The flexible sheet 1 is shaped so as to define, on the one hand, a bottom 2 of the reservoir bearing on the ground 3 and supporting thereover the mass 7 of the liquid to be retained and, on the other hand, a peripheral space formed by the rest of the sheet 1 (i.e. the peripheral part of the sheet which surrounds bottom 2) folded back on itself towards the inside along the whole of its periphery. The free edge 4 of the sheet is connected mechanically by means of connection means 5 to the bottom 2. Thus, the above mentioned peripheral space forms a sort of bell or tube 8 which is not closed at its base and which is partially filled with liquid 9 and partially with gas (air) 10. The pressure of the air imprisoned in the top part of the tube is determined by the weight of the column or liquid of height H between the level of the liquid mass 7 in the reservoir and the level of the liquid mass 9 in the tube 8.

An external belt 11 may surround tube 8 for safety purposes.

Of course, as shown in FIG. 1, it is advantageous for the peripheral folded down zone of sheet 1 not to be connected sealingly with bottom 2, so that a gap 6 remains through which the filling liquid of the reservoir may freely penetrate into tube 8.

It is therefore advantageous for the connection means 5 to provide a discontinuous connection. These means may be of any appropriate type easy to use and handle and inexpensive. FIGS. 2 to 5 illustrate some examples thereof. In these Figures, the numerical references 2 and 4 have been kept for designating, as in FIG. 1, the bottom and the edge of the folded down part of the sheet, respectively.

Figure 2:
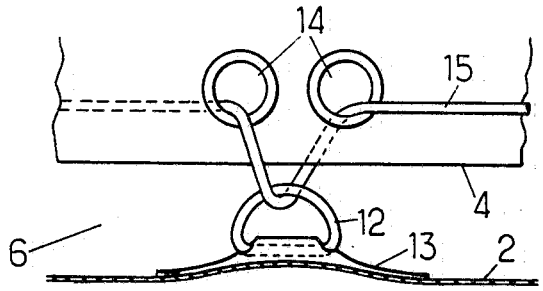
FIGS. 2 to 5 are schematical views showing different embodiments of a part of the reservoir of FIG. 1.

In FIG. 2, a ring 12 is fixed by a lug 13 to the bottom 2 whereas two eyelets 14 are formed in the folded down zone in the neighborhood of edge 4; a lace 14 passes through the eyelets 14 and ring 12, the lace 15 running right around the periphery of tube 8.

Figure 3:
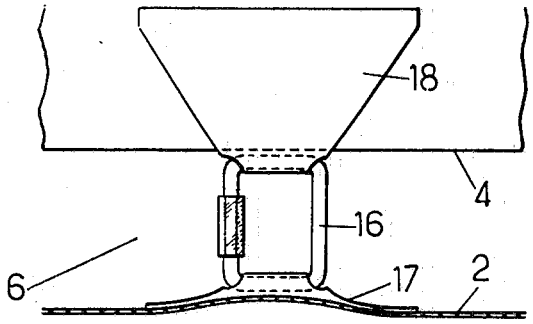

In FIG. 3, a snap fit link 16 is engaged in two lugs 17 and 18 secured to bottom 2 and edge 4 respectively.

Figure 4:
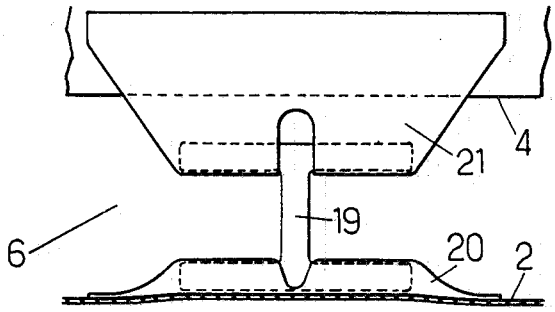

In FIG. 4, a rigid H shaped piece 19 has its arms engaged respectively in two parts 20 and 21 firmly secured to the bottom 2 and edge 4, respectively.

Figure 5:
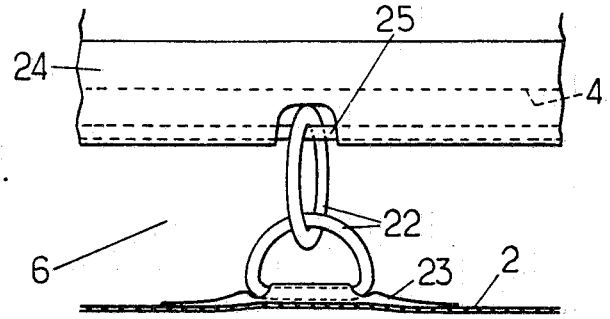

Finally, in FIG. 5, one or more rings 22, retained by a lug 23 secured to bottom 2 have passing therethrough a lace 24 running through a gusset 25 provided along edge 4.

Figure 6:
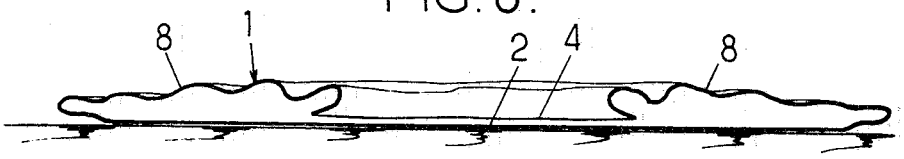
FIGS. 6 to 9 are schematical views illustrating the process for setting up the reservoir of FIG. 1.

Setting up of the reservoir of the invention is accomplished as follows:

The flexible sheet 1 is first of all extended on a preferably approximately flat ground surface. Then the peripheral zone of the sheet is folded back inwardly so as to bring edge 4 approximately opposite the fixing means 5 these fixing means are secured so as to assemble edge 4 with bottom 2. If required, the sheet is shaken so that a little air penetrates into the peripheral zone so that it is not completely flattened (FIG. 6).

Figure 7:
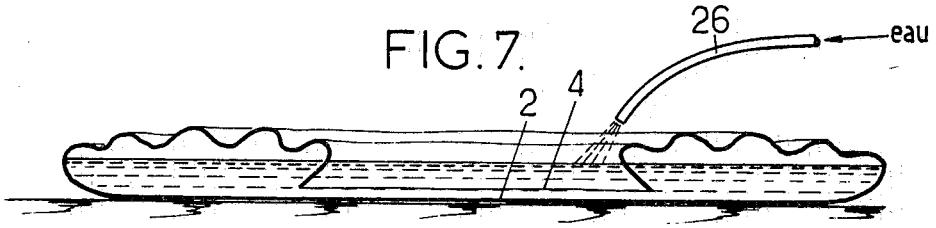

Liquid (for example water) is then poured (at 26) into the central region and penetrates at least partially, through gap 6, into the peripheral portion 8, this filling being continued until the whole of gap 6 (FIG. 7) is completely covered.

Figure 8:
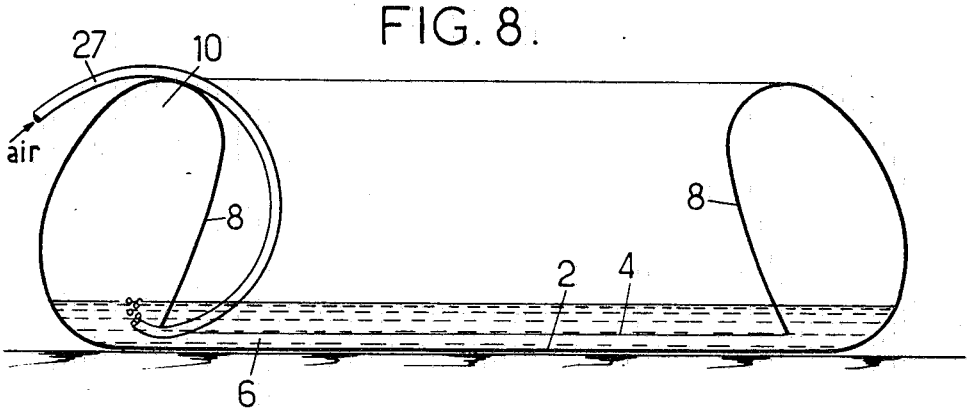

A pipe 27 is then fitted into the central zone for example through gap 6, and pressurized air is fed in so as to inflate the peripheral zone and to give it the shape of a tube 8 (FIG. 8). For example, this operation may be achieved using a simple household vacuum cleaner suitably connected.

Figure 9:
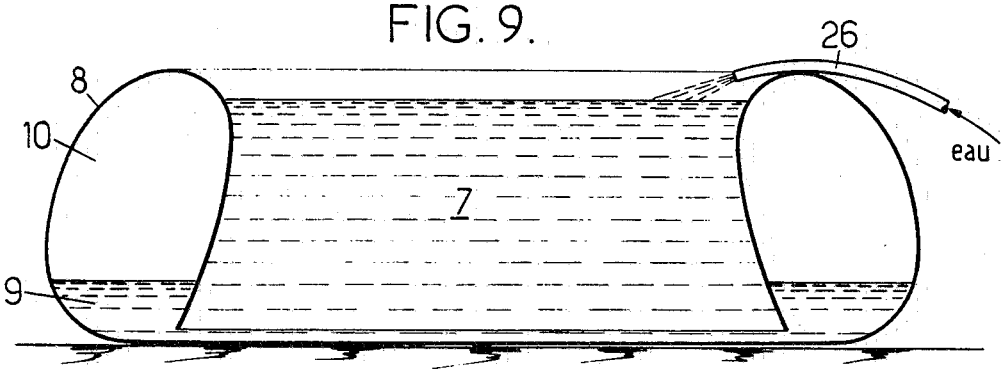

Once tube 8 has been given its shape, inflation with air is interrupted and liquid is poured in until the filling is complete (FIG. 9). The weight of the water column H causes a sufficient pressurization of air 10 to provide the stability of tube 8, the pressure variations due to air leaks being automatically compensated for by a rise in the level of the liquid mass 9 in tube 8.

As is evident, and as it follows moreover already from what has gone before, the invention is in no wise limited to those of its modes of application and embodiments which have been more especially considered; it embraces, on the contrary, all variants thereof.

What is claimed is:

1. An inflatable reservoir for containing a liquid, more especially an inflatable swimming pool, made of a single sheet of a flexible and fluid tight material defining:

a central zone forming the bottom supporting thereover the liquid filling the reservoir, and a peripheral space formed by the rest of the sheet folded back on itself inwardly along the whole of its periphery so as to form approximately a peripheral tube, filled partially with liquid coming from the liquid filling the reservoir and partially with gas coming from a gas filling:

said reservoir being furthermore provided with discontinuous mechanical connection means for connecting the free edge of the folded down remainder of the sheet to the central zone, at least one passage being provided between the central zone and the peripheral space so that the liquid filling the central zone flows into the peripheral space.

2. The reservoir as claimed in claim 1, wherein said discontinuous mechanical connection means are lacing means.

3. The reservoir as claimed in claim 1 wherein said at least one passage provided between the central zone and the peripheral space is a gap existing, in the operational position of the reservoir, along the whole of its periphery between the free edge of the folded down remainder of the sheet and said central zone.

4. The reservoir as claimed in claim 1, further comprising a peripheral safety belt surrounding said tube.

5. A method for setting up an inflatable reservoir, more especially an inflatable swimming pool, such as claimed in claim 1, including the following steps:

spreading out the flexible sheet forming the reservoir on an approximately flat support, folding back the peripheral zone of the sheet inwardly so as to bring the free peripheral edge of the flexible sheet opposite a fixing means provided on the periphery of the central zone of the flexible sheet, securing the fixing means so as to mechanically assemble together the free edge of the sheet and the bottom, introducing liquid until the space between the free edge of the sheet and the bottom is covered, and introducing gas into the peripheral space so that this latter space assumes approximately the shape of a tube, until the excess gas escapes, and completing filling of the reservoir with liquid.

6. A method as claimed in claim 5, wherein filling the peripheral space with gas includes introducing the free end of a pressurized air feed pipe between the free edge of the sheet and the bottom.

* * * * *